US006345698B1

(12) United States Patent
Ravishankar

(10) Patent No.: US 6,345,698 B1
(45) Date of Patent: Feb. 12, 2002

(54) SIMPLIFIED ROLLER GUIDE

(75) Inventor: Gurumurthi Ravishankar, Englewood, CO (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/507,981

(22) Filed: Feb. 22, 2000

(51) Int. Cl.[7] ..... B66B 7/04
(52) U.S. Cl. ..... 187/410; 187/409
(58) Field of Search ..... 187/409, 410, 187/414, 238; 104/243, 245, 247; 105/30

(56) References Cited

U.S. PATENT DOCUMENTS 1,854,976 A * 4/1932 Brady ..... 187/410 X
2,251,963 A * 8/1941 Spiro ..... 187/410
2,265,086 A * 12/1941 Spiro ..... 187/410
2,277,565 A * 3/1942 Spiro ..... 187/410
3,070,190 A * 12/1962 Rogers et al. ..... 187/410 X
3,669,222 A * 6/1972 Takamura et al. ..... 187/410
5,033,589 A * 7/1991 Rhodes ..... 187/410
5,107,963 A * 4/1992 Rocca et al. ..... 187/410
5,117,946 A * 6/1992 Traktovenko et al. ..... 187/410
5,632,358 A * 5/1997 Maeda et al. ..... 187/410
6,050,370 A * 4/2000 Jung ..... 187/410

* cited by examiner

*Primary Examiner*—Eileen D. Lillis
*Assistant Examiner*—Thuy V. Tran

(57) ABSTRACT

A roller guide for improving the movement of an elevator car on T-shaped guide rails. The roller has first and second wheels rotatably mounted on an elevator car and spring biased to rollably engage the sides of the nose portion of a T-shaped guide rail. A bumper is secured between the wheels to slidably engage the edge of the nose portion of the T-shaped guide rail and minimize lateral sway of the elevator car as it travels. The bumper also allows for the inventive roller guide to be used to replace the sliding guides of certain types of elevators without exceeding the maximum throat clearance. The roller guide, when installed, is dimensioned to meet the required safety tolerances of the elevator and allow for safe operation of the elevator safeties.

9 Claims, 2 Drawing Sheets

SIMPLIFIED ROLLER GUIDE

BACKGROUND OF THE INVENTION

Technical Field

The present invention relates to roller guides used in elevators. More particularly, the present invention relates to a simplified roller guide that allows an elevator system utilizing a sliding guide system to be upgraded while maintaining required safety tolerances.

The use of both sliding and roller guides on elevators is well known in the prior art. A sliding guide is a metal plate attached to an elevator. The metal plate has a notch removed from it. The nose portion of a T-shaped guide rail protrudes into the notched out area, and the edges of the notched-out area contact and slide along the nose portion of the guide rail.

Sliding roller guides cannot generally be used on dry guide rails because of the obvious effects of unbuffered metal-on-metal contact. Heat generated by the sliding of the guide on an unlubricated guide rail causes stresses to the metal which result in the accelerated wear of the system. Rapidly worn system parts increases both the costs of operating an elevator system and the down time due to maintenance.

To avoid wear on the guide rails of a sliding guide type elevator system, a lubricant is applied to the rails. However, application of the lubricant often results in an environmentally unfriendly condition. The lubricant is either a liquid or a liquid dispersed in a soap-based carrier. Any liquid applied to a vertical surface will run, and applying either type of lubricant to a vertical surface such as an elevator guide rail will result in the lubricant running down the rail surface to the ground. Contact of the lubricant with the ground poses a threat to the environment in that the lubricant may seep into the soil and contaminate a subsurface water supply.

Furthermore, a lubricant is typically applied to the guide rails of an elevator system with an automatic mechanical oiling device. Use of a mechanical device increases the chances for mechanical breakdown. Breakdown of any piece of mechanical equipment, especially one that is not critical to the operation of a system, translates into additional labor requirements and service and maintenance costs.

Sliding guides are also a source of excessive noise during operation of the elevator. Because of the metal-on-metal contact between the sliding guide and the elevator guide rail, even with a lubricant sliding guides are generally unnecessarily noisy.

An alternative to sliding guides is conventional rolling guides. Elevator manufacturers must comply with stringent safety requirements, and these safety requirements impose strict controls on the use of conventional roller guides. Among these safety requirements is a maximum throat clearance. The throat clearance is defined as the distance between the nose of the T-shaped rail and the surface of the roller or sliding guide opposing the nose of the rail.

Prior art conventional roller guides often use three rollers. Maeda describes such a system in U.S. Pat. No. 5,632,358. In that system, one roller contacts each side of the nose portion of the T-shaped guide rail while a third roller is situated perpendicularly to the first two and contacts the edge of the nose portion of the T-shaped rail. Installing this type of conventional roller guide in place of a sliding guide in certain types of elevators will increase the throat clearance beyond the maximum allowable distance making the safeties in certain elevators either inoperable or at least out of compliance with the required safety standards.

In upgrading an elevator system using sliding guides to one using roller guides, the maximum throat clearance between the T-shaped guide rail and the elevator safety must not be exceeded. What is needed is a way to upgrade certain elevator systems that currently utilize the inefficient, environmentally unfriendly, and noisy sliding guides to an elevator system that utilizes a rolling guide system without comprising passenger safety or comfort.

SUMMARY OF THE INVENTION

The present invention is directed to an elevator car roller guide having a pair of wheels mounted on an elevator car and being configured in a coplanar fashion and positioned to rollably engage the sides of a nose portion of a T-shaped guide rail. A bumper is also mounted on the elevator car. This bumper is positioned on the elevator car to maintain proper clearance between the nose of the T-shaped guide rail and the elevator safeties, thus ensuring proper functioning of the elevator safeties. In the event that the bumper contacts the edge portion of the nose portion of the T-shaped guide rail, the bumper slidably engages the T-shaped guide rail to prevent the elevator from swaying.

The elevator car roller guide may be mounted on a base plate that can be mounted on the elevator.

The wheels of the elevator car roller guide are spring-biased toward each other to engage the sides of the nose portion of the T-shaped guide rail. Flexible plates (leaf springs) fixed at their opposing ends may be used as springs to exert the force that biases the wheels toward each other. Alternately, a plurality of flexible plates can be stacked and used to spring-bias each wheel.

The ends of each of the flexible plates may be fixed to a pair of support members. These support members may be fixed directly to the elevator car, or they may be fixed to the base plate that is fixed to the car.

The bumper may also be secured to the base plate at a point intermediate the first and the second wheel and positioned to sidably engage the nose portion of the T-shaped guide rail should contact between the bumper and the guide rail occur. The invention also contemplates a polymeric coating disposed on the bumper in order to reduce the friction generated during the contact of the bumper with the T-shaped guide rail. In the preferred embodiment, the polymeric coating would be polytetrafluoroethane (PTFE).

The axles that rotatably support the wheels may be bolted or welded or otherwise affixed to the springs. Furthermore, the axles may be mounted across the holes cut into the springs. If the spring constitutes a plurality of plates stacked upon each other, the plate situated on either end of the stack can be configured to be radially contoured around the axle.

The wheels of the present invention may be fabricated from a variety of materials. These materials include, but are not limited to, rubbers, urethanes, or any type of polytetrafluoroethane-coated material. The rubbers may be natural or synthetic, and the preferred urethane would be a polyether-based urethane. Both rubbers and urethanes provide for less noise during operation than do most other types of material. Alternately, a plurality of wheels can be mounted on a plurality of springs to engage each side of the nose portion of a T-shaped guide rail.

BRIEF DESCRIPTION OF THE DRAWINGS

Referring now to the drawings wherein like elements are numbered alike in the several figures.

DETAILED DESCRIPTION OF THE PREFERRED EMBODIMENTS

Figure 1:
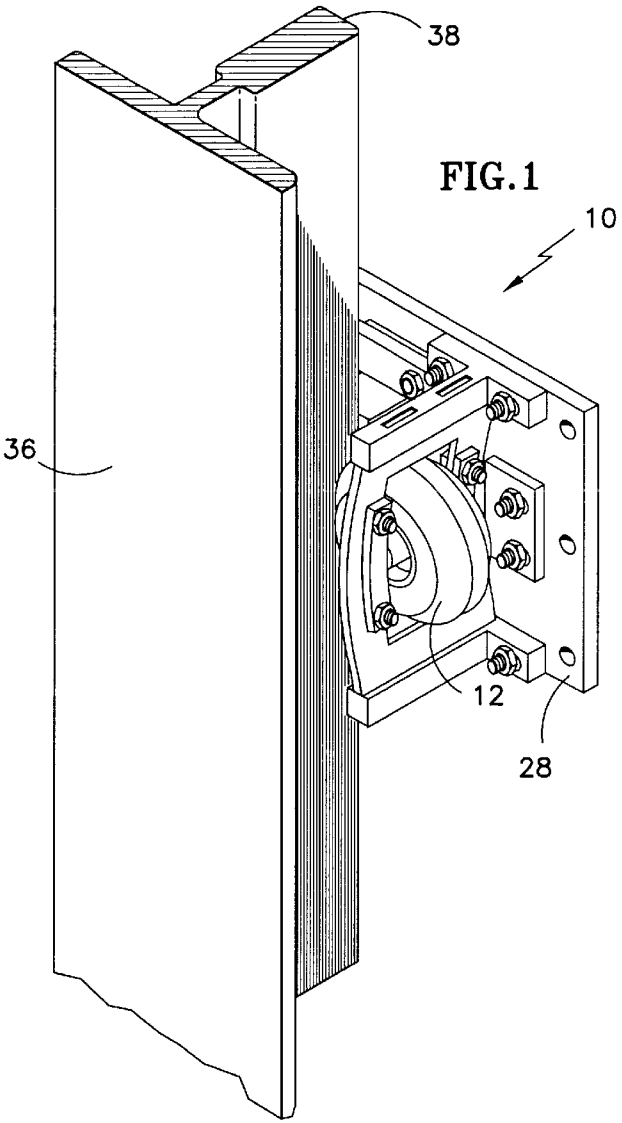
FIG. 1 is a perspective view of a rolling guide of the invention situated on a guide rail.

The inventive roller guide is shown in FIG. 1. A roller guide 10 is illustrated, as it would be seated on a T-shaped guide rail. Roller guide 10 is secured to an elevator car. Rollers 12 and 14 are mounted on roller guide 10. Rollers 12 and 14 rollably engage the opposing sides of the nose portion of a T-shaped guide rail to roll freely on the guide rail as the elevator ascends and descends an elevator shaft.

Figure 2:
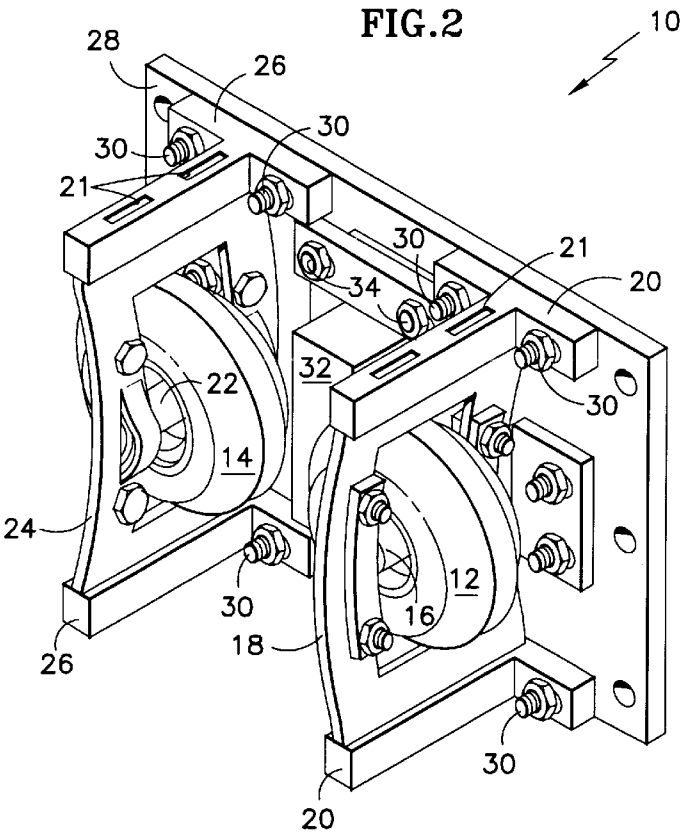
FIG. 2 is a perspective view of the rolling guide of the invention.

Referring to FIG. 2, roller guide 10 is depicted in greater detail. Roller guide 10 contains roller 12 mounted on an axle 16. Roller 12 is freely rotatable on axle 16. The ends of axle 16 are secured to the opposing sides of a cutout portion in the center of a leaf spring 18. Each end of leaf spring 18 is secured to each member of a pair of support members 20. Support members 20 are secured to a base 28, and base 28 is installed on an elevator car (not shown).

Figure 7:
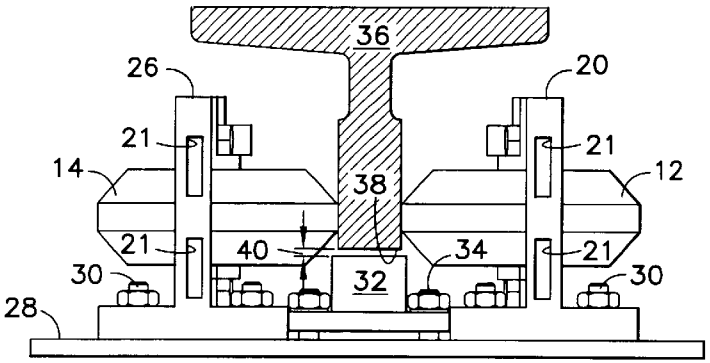
FIG. 7 is a plan view of the rolling guide, as it would be situated on a guide rail.

Second roller 14 is mounted on a second axle 22. Roller 14 is freely rotatable on axle 22. The ends of axle 22 are secured to the opposing sides of a cutout portion in the center of a second leaf spring 24. Each end of leaf spring 24 is secured to each member of a second pair of support members 26 in the same manner as leaf spring 18 is secured to support members 20. Second pair of support members 26 is secured in a similar fashion as support members 20 are to base 28. Rollers 12 and 14 are dimensioned to be similar to each other, and are positioned to be coplanar and symmetrical with respect to each other when mounted on base 28, as shown in FIG. 7.

Figure 3:
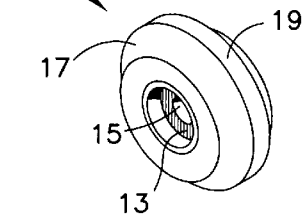
FIG. 3 is a perspective view of a roller of the rolling guide of the invention.

Roller 12 is illustrated in greater detail in FIG. 3. Roller 14 is similarly configured. Roller 12 is essentially a wheel comprising of a hub portion 13 that houses wheel bearings and supports a tire 17. Hub portion 13 has a center hole 15 for accommodating axle 16. Tire 17 is mounted on the outer rim of hub portion 13. Tire 17 is fabricated from any suitable material that is well known to those skilled in the art. The preferable materials for the tires are "soft" materials such as rubbers or urethanes. As is well known in the art, a polyether-based urethane is a better choice for tire 17 than a polyester-based urethane because the latter type tends to be more susceptible to deterioration as a result of heat and moisture. Furthermore, tires fabricated from rubbers and urethanes generate less noise than "hard" materials like steel do. Tires can also be fabricated from polytetrafluoroethane or a similar material.

Figure 4:
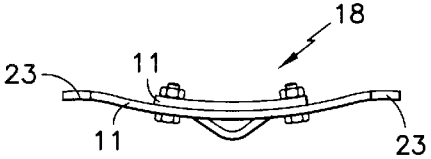
FIG. 4 is a side view of a spring of the invention having two leaves.

Leaf spring 18 is illustrated in more detail in FIG. 4. Leaf spring 24 is similarly configured. Leaf spring 18 consists of a series of stacked plates 11 that are secured together with bolts and nuts or a similar securement means. Disposed on each end of leaf spring 18 are tabs 23. The bottom plate of leaf spring 18 is configured to accommodate the ends of axle 16, upon which roller 12 is mounted. Various methods exist for connecting an axle to a leaf spring. For example, a "U" bolt may be clamped around the axle and the ends of the "U" bolt may be bolted into the bottom leaf of the leaf spring. Alternately, the bottom leaf of the leaf spring could be contoured around the axle, and the contour could hold the axle in place against the second leaf of the leaf spring up from the bottom. These, as well as other methods, are well known in the art.

Figure 6:
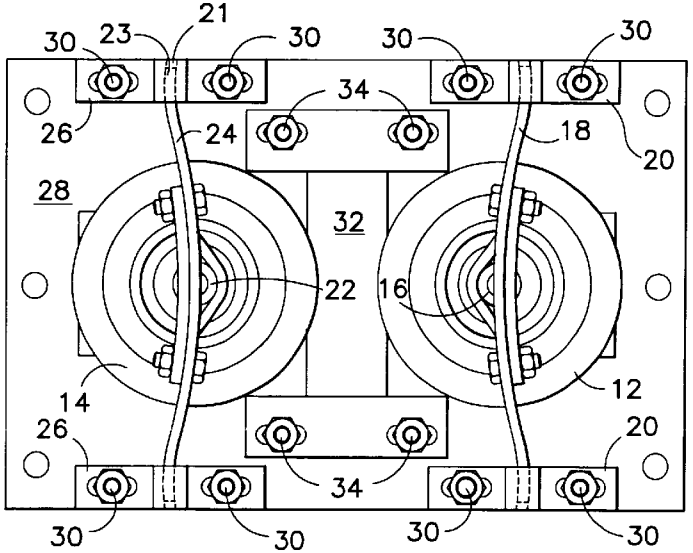
FIG. 6 is a side view of the rolling guide.
Figure 5:
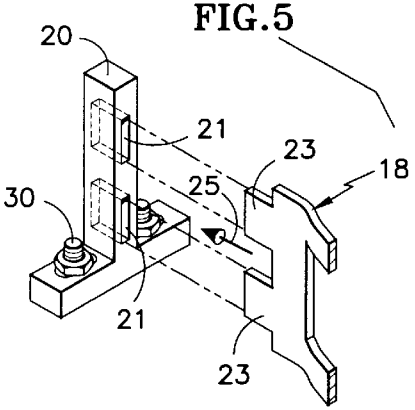
FIG. 5 is a perspective view of slots on a support arm as the tabs of a leaf spring are inserted into the slots.

In the preferred embodiment, leaf springs 18 and 24 are connected to support member 20 and 26 using tabs and slots. Referring now to FIG. 5, one member of pair of support members 20 is illustrated. The second member of the pair of support members 20, as well as both members of the pair of support members 26, is similarly configured. The protruding arm of support member 20 contains slots 21. Slots 21 are positioned and dimensioned to accommodate tabs 23 disposed on each end of leaf spring 18. Tabs 23 on one end of a leaf spring are inserted into slots 21 on one member of a pair of support members by aligning tabs 23 with slots 21 and moving leaf spring 18 in the direction of arrow 25. Inserting tabs 23 on the opposing end of a leaf spring into slots 21 on the second member of a pair of support members biases the leaf spring. In order to be properly mounted, once tabs 23 are inserted into slots 21 on their respective support members, leaf springs 18 and 24 are biased toward each other, as shown in FIG. 6. In order to minimize noise and wear, the spring rate on leaf springs 18 and 24 should exert the minimum amount of pressure necessary to hold rollers 12 and 14 against the sides of the nose portion of a T-shaped guide rail.

Support members 20 and 26 are generally secured to base 28 using bolts 30 or a similar means of securement. Cushions made of rubber, polytetrafluoroethane, or some similar material can be seated between support members 20 and 26 and base 28 in order to avoid metal-on-metal contact, thus reducing the chances of stressing the parts. Alternately, support members can be welded directly onto base 28.

If rollers 12 and 14 are properly aligned, only an outer edge 19 of tire 17 will maintain contact with the sides of the nose portion of a T-shaped guide rail. Proper alignment will ensure minimal wear of tire 17. Any misalignment of the rollers will result in uneven tire wear that will cause stresses on the wheels, axles, leaf springs, and support members. Such stresses may lead to premature aging of the parts and, consequently, increased operating costs. In order to ensure proper alignment of the rollers, it is imperative that axles, leaf springs, and support members are properly attached to each other, and that support members are properly secured to base 28.

Furthermore, leaf springs 18 and 24 should be similarly tensioned. Even if rollers 12 and 14 are properly aligned, uneven tensions on leaf springs 18 and 24 will result in one roller being biased against the side of the nose of the T-shaped guide rail more than the other roller. Such a situation will result in one roller wearing faster than the other. Moreover, leaf springs 18 and 24 should be tensioned to exert only the minimum amount of pressure necessary on the guide rail to maintain contact with the guide rail and to prevent the elevator car from swaying between the rollers. Maintaining such contact will also minimize noise generated by the movement of the rollers 12 and 14 along the guide rail.

FIG. 6 illustrates a bumper 32 situated between rollers 12 and 14. Bumper 32 is positioned to be midway between roller 12 and 14. Bumper 32 is secured to base 28 with bolts 34, or is welded onto base 28, or is attached with some similar method of securement. Alternately, bumper 32 can be cast from the same mold as base 28 thus eliminating the need for bolts 34, welding, or any method of attachment.

FIG. 7 is a top view of roller guide 10, as it would be situated on T-shaped guide rail 36. Guide rail 36 has a nose portion 38. The distance between the surface of nose portion 38 and the surface of bumper 32 is defined as a throat clearance 40. During operation of an elevator, irregularities and undulations along the length of guide rail 36 cause throat clearance 40 to vary. Bumper 32 may make contact with the nose portion 38 during ascent and descent of the elevator as it encounters these irregularities and undulations along the length of guide rail 36, thus preventing the elevator car from swaying too far from one side to the other side.

In the prior art, a third wheel is situated where bumper 32 is situated in the present invention. Replacement of this third wheel with bumper 32 allows sliding guides on certain types of elevators to be replaced with roller guides while still maintaining an industry required throat clearance 40. If throat clearance 40 is exceeded, the rollers in a conventional safety may not sufficiently brake the elevator.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An elevator car roller guide for use in an elevator system having an elevator car movable between a pair of T-shaped guide rails, each guide rail having a nose portion with opposing sides and an edge portion, said roller guide comprising:

a base plate mountable to said elevator car;

a first wheel rotatably mounted on said base plate, said first wheel being positioned and configured to rollably engage one of said sides of said nose portion;

a second wheel rotatably mounted on said base plate, said second wheel being positioned and configured to rollably engage a side of said nose portion opposing said first side;

a stationary bumper mounted on said base plate, said bumper being adapted to slidably engage said edge portion in the event that contact is made between said bumper and said guide rail, and wherein:

said first wheel and said second wheel are biased respectively with a first spring and a second spring to engage the sides of said nose portion, said first spring and said second spring being flexible plates, each plate being fixed at its opposing ends and configured in such a manner so as to exert a tension.

2. The elevator roller guide of claim 1 wherein said first spring and said second spring are each comprised of a plurality of flexible plates stacked on each other, each stack of plates being fixed at its opposing ends and configured in such a manner as to exert a tension.

3. An elevator car roller guide for use in an elevator system having an elevator car movable between a pair of T-shaped guide rails, each guide rail having a nose portion with opposing sides and an edge portion, said roller guide comprising:

a base plate securable to said elevator car;

a first spring operably mounted to said base;

a first axle secured to said first spring;

a first wheel rotatably mounted on said first axle and positioned and configured to rollably engage a first side of said nose portion, and being positioned and configured such that the plane of said first wheel is substantially parallel to the plane of said base plate;

a second spring operably mounted to said base;

a second axle secured to said second spring;

a second wheel rotatably mounted on said second axle and positioned and configured to rollably engage a second side of said nose portion opposite to said first side, and being positioned and configured such that the plane of said second wheel is substantially parallel to the plane of said base plate; and a stationary bumper having a polymeric coating disposed thereon, said bumper disposed on said base plate, said bumper being adapted to slidably engage said edge portion in the event that contact is made between said bumper and said guide rail.

4. The elevator car roller guide of claim 3 wherein said polymeric coating on said bumper is polytetrafluoroethane.

5. The elevator car roller guide of claim 3 wherein said first spring and said second spring are comprised of a plurality of flexible plates stacked on each other, each stack being fixed at its opposing ends and configured in such a manner as to exert a tension.

6. The elevator car roller guide of claim 5 wherein a first hole is cut into said first spring and a second hole is cut into said second spring and said first wheel is positioned in said first hole and said second wheel is positioned in said second hole.

7. The elevator car roller guide of claim 6 wherein said first axle upon which first wheel is rotatably mounted is positioned across said first hole and held onto said first spring by one of said stacked plates of said first spring being contoured around said first axle and wherein said second axle upon which said second wheel is rotatably mounted is positioned across said hole and held onto said second spring by one of said stacked plates of said second spring being contoured around said second axle.

8. The elevator car roller guide of claim 6 wherein said first axle upon which first wheel is rotatably mounted is positioned across said first hole and welded onto said first spring and said second axle upon which second wheel is rotatably mounted is positioned across aid second hole and welded onto said second spring.

9. The elevator car roller guide of claim 6 wherein said first axle upon which first wheel is rotatably mounted is positioned across said first hole and bolted onto said first spring and said second axle upon which second wheel is rotatably mounted is positioned across said second hole and bolted onto said second spring.

* * * * *